US005337830A

United States Patent [19]

Bowman

[11] Patent Number: 5,337,830

[45] Date of Patent: Aug. 16, 1994

[54] FIRE FIGHTING FOAM GENERATION SYSTEM

[75] Inventor: Christopher J. Bowman, Coromandel Valley, Australia

[73] Assignee: Allen William Rogers, Australia

[21] Appl. No.: 923,971

[22] PCT Filed: Mar. 19, 1991

[86] PCT No.: PCT/AU91/00099

§ 371 Date: Oct. 28, 1992

§ 102(e) Date: Oct. 28, 1992

[87] PCT Pub. No.: WO91/14477

PCT Pub. Date: Oct. 3, 1991

[30] Foreign Application Priority Data

Mar. 19, 1990 [AU] Australia ..... PJ9123

[51] Int. Cl.[5] ..... A62C 5/02

[52] U.S. Cl. ..... 169/14; 169/70

[58] Field of Search ..... 169/14, 15, 44, 70

[56] References Cited

U.S. PATENT DOCUMENTS

| | | | |
|---|---|---|---|
| Re. 19,965 | 5/1936 | Schröeder et al. | 169/15 X |
| 3,186,490 | 6/1965 | Jamison et al. | 169/14 X |
| 3,272,263 | 9/1966 | Jamison | 169/15 |
| 3,393,745 | 7/1968 | Durstewitz | 169/15 |
| 3,607,779 | 9/1971 | King et al. | 169/14 X |
| 3,780,812 | 12/1973 | Lambert | 169/15 |
| 3,822,217 | 7/1974 | Rogers | 252/359 E |

FOREIGN PATENT DOCUMENTS

| | | | |
|---|---|---|---|
| 170234 | 2/1986 | European Pat. Off. . | |
| 3620574 | 12/1987 | Fed. Rep. of Germany . | |
| 588989 | 1/1978 | U.S.S.R. | 169/14 |
| 719637 | 3/1980 | U.S.S.R. | 169/14 |
| 756035 | 8/1980 | U.S.S.R. | 169/70 |
| 1388060 | 4/1988 | U.S.S.R. . | |
| 1391661 | 4/1988 | U.S.S.R. | 169/15 |
| 1475684 | 4/1989 | U.S.S.R. | 169/15 |
| 1648508 | 5/1991 | U.S.S.R. | 169/70 |
| 509821 | 7/1939 | United Kingdom . | |
| 1091389 | 11/1967 | United Kingdom . | |
| 1134822 | 11/1968 | United Kingdom . | |
| 1175062 | 12/1969 | United Kingdom . | |
| 1217856 | 12/1970 | United Kingdom . | |
| 1394140 | 5/1975 | United Kingdom . | |
| 1441259 | 6/1976 | United Kingdom . | |

*Primary Examiner*—David M. Mitchell
*Assistant Examiner*—Gary C. Hoge
*Attorney, Agent, or Firm*—Eckert Seamans Cherin & Mellott

[57] ABSTRACT

A system for generating fire-fighting foam whereby a foam-forming chemical is mixed with water and air to form foam. The foam is pressurized preferably by the provision of pressurized air to force the foam out of a duct within which the foam is formed and to direct the foam at the seat of the fire or to the site to be protected against fire. A metal mesh is rotatable and preferably helical with respect to the direction of travel of the foam which acts as a catalytic agent and helps to clear foam from the duct within which the foam forms.

1 Claim, 4 Drawing Sheets

FIRE FIGHTING FOAM GENERATION SYSTEM

BACKGROUND OF THE INVENTION

This invention relates to a fire fighting foam generation system and in particular it relates to a system for mixing a foam forming chemical with water and air and for directing the foam so formed to the seat of the fire, or an area which is to be protected against a fire.

It is already known to use foam in fire-fighting and according to a method already in use, the foam forming chemical and water are mixed and issue from a jet directed to the area to be protected.

It is also well-known to protect buildings by sprinkler systems which are activated in the event of a fire and which spray the area at the seat of the fire.

It is well-known that the use of sprays of water in buildings when used for fire fighting purposes cause considerable damage to the contents of the buildings.

The use of foam has the advantage that by appropriate mixing of the foam generating chemical with the water, a relatively dry foam can result which, though effective in fighting fires, may do less damage to contents of areas where it is used and this is particularly so in areas where electrical equipment is involved.

The object of this invention is to provide a fire fighting foam generating system which is applicable in general fire fighting where a jet of foam, in particular, is advantageous and also for use in buildings, such as multi-storey buildings, where the areas themselves can be protected by foam as opposed to water sprays.

BRIEF SUMMARY OF THE INVENTION

In one form the invention could be said to reside in a fire fighting foam generation system including means for mixing water, a fire fighting foam forming chemical and air to form a foam within a duct, means to pressurize the foam to carry the foam through the duct to the site of the fire, or to the site to be protected against fire, wherein a catalytic metal mesh located for relative circumvolutive contact with foam with respect to a direction in which the foam is to be carried downstream of a site where the water, the fire fighting foam forming chemical and air are mixed.

The actual construction of the invention can be considerably varied but according to one form a duct is provided which can be directed towards the area to be protected, and in this duct is mounted a fan which is driven by a motor which also drives a liquid pump, which in turn is connected to a flow control device which allows the water and foam chemical to be metered to the pump to issue from a jet fed by the pump as a spray into the air-stream in the duct, the spray being directed outwardly as well as along the duct to fill the duct and in its passage being directed into a zone in the duct which houses a catalysing unit such as a screen of a material selected to aid foam formation.

BRIEF DESCRIPTION OF THE DRAWINGS

The actual invention can be applied in various ways but for a better understanding of the general nature of it to be fully appreciated several embodiments will now be described with reference to the accompanying drawings wherein.

DETAILED DESCRIPTION

Figure 1:
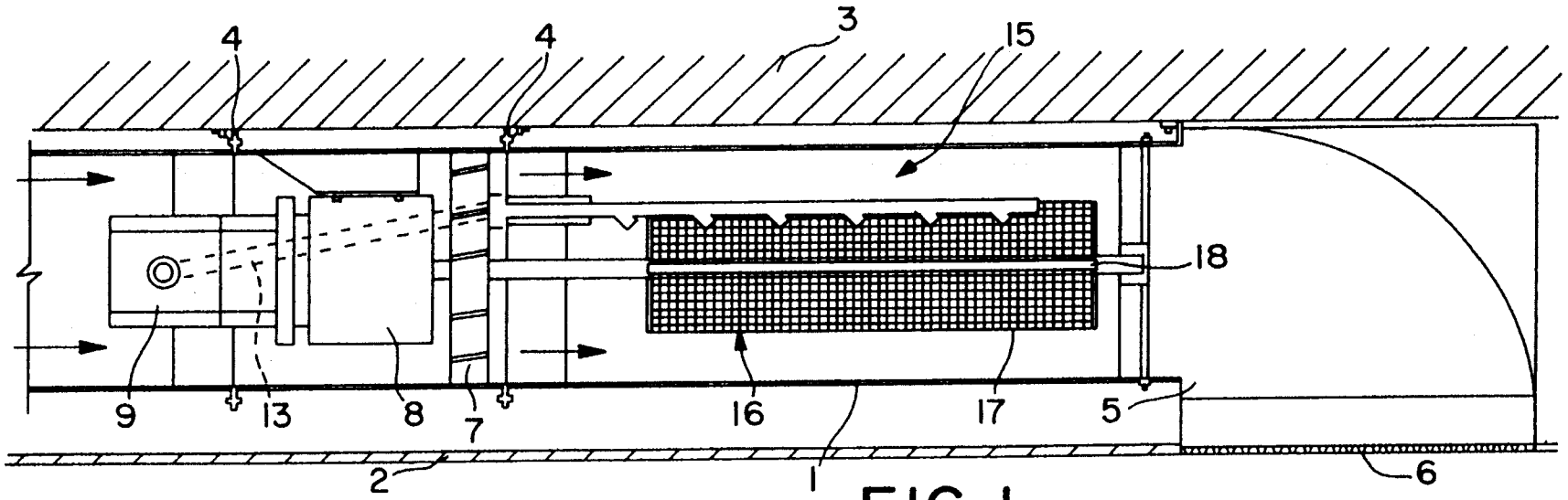
FIG. 1 is a schematic cross-sectional view from one side of a first embodiment of the invention installed in the ceiling space of a building.
Figure 2:
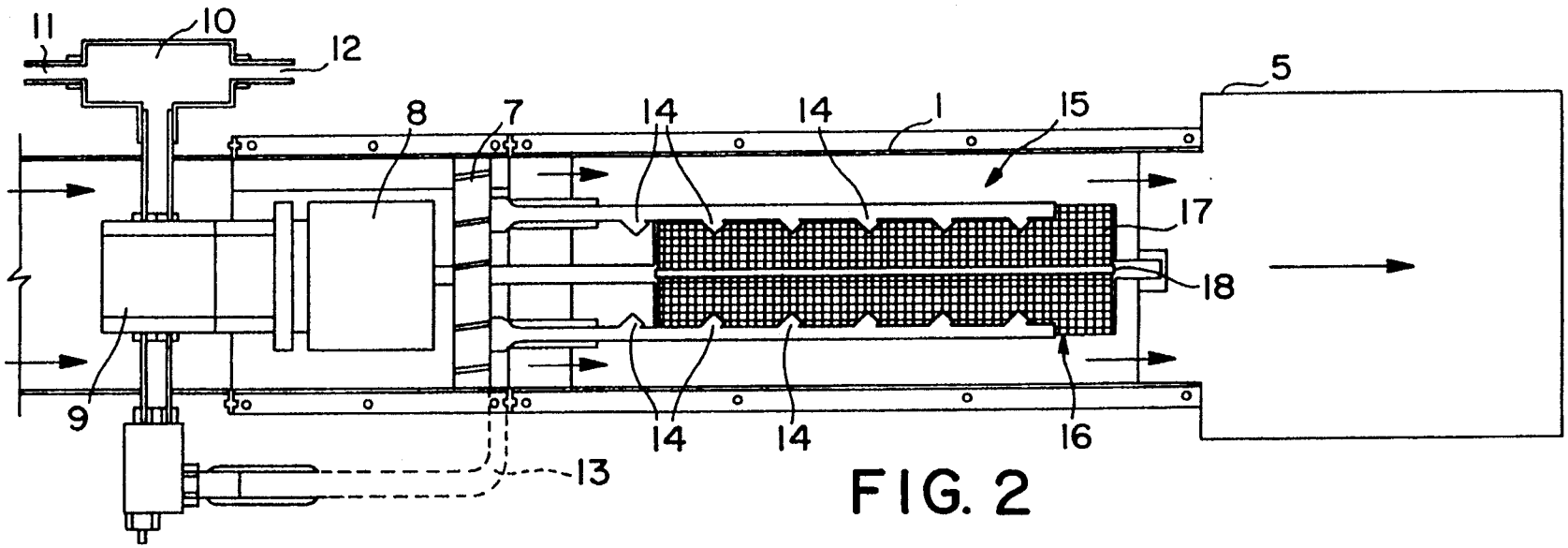
FIG. 2 is a view from above of the same embodiment of the invention shown in FIG. 1.

In the first embodiment shown, a fire fighting generating system according to the invention is fitted aside and within an air-conditioning duct 1 having a controlled airflow and located between a ceiling 2, and a floor above 3. The duct 1, is fastened to the floor above with brackets 4 and ends in a terminal box 5, directing flow through an outlet 6 in the ceiling 2.

A fan 7 is coupled to a motor 8 and is arranged to blow air into the duct. Also driven by the motor is a liquid pump 9 which has an inlet connected to a mixer 10 to which water is fed through line 11 while foaming chemicals are fed through line 12. The mixer is arranged as a flow control member to regulate the proportions of the water and the foam-forming chemical drawn into the pump 9.

The outlet of the pump 9 leads outside of the duct to a conduit 13 shown in broken outline and to two rows of spaced apart jets, each jet 14 re-entering the duct and directing water and foaming chemical mix into the duct in the direction of the airflow.

The jets can be of any approved type which sprays the mixture of water and foam forming chemical into the area 15 to preferably atomize the mixture and to fill the duct in this area. In this area is disposed a catalysing unit 16 which in this case is a mesh of metal wire 17 wound closely around a rotatable support 18. The support comprises four evenly spaced wings extending laterally from an axle and driven by motor 8. The foam is directed onto and through the mesh of metal wire 17.

In this way the mixture of water and the foam forming chemical is directed into the selected velocity air-stream flowing into the duct I and with the aid of the catalysing unit 16 is distributed in the air in the form of foam. The moisture content of the foam can be controlled through the mixer 10 by appropriate regulation of the foam forming chemical and water mix, which foam can then be directed through the terminal box to the fire, or to an area below simply so that the area is protected.

The rotatable supports of the catalytic unit 16 are shown as having straight wings, however, in one form the wings can be helically twisted one quarter of a turn about the supporting axle.

It will be realised, that by such an arrangement a multi-storey building can have an inbuilt fire protection unit, associated with the air-conditioning unit or if required, independently of such a unit by installations at the various floors. Protection will then be by foam instead of water jets, as is customary at the present time, the use of foam being much less damaging to contents of buildings and also reducing the hazard of damage to electrical installations which exists where water is sprayed into the areas.

It is found that by providing this arrangement an expansion of the volume of approximately 1:7 can be achieved rather than the approximately 1:2 expansion found in the known hand-held foaming chemical fire extinguishers.

Figure 3:
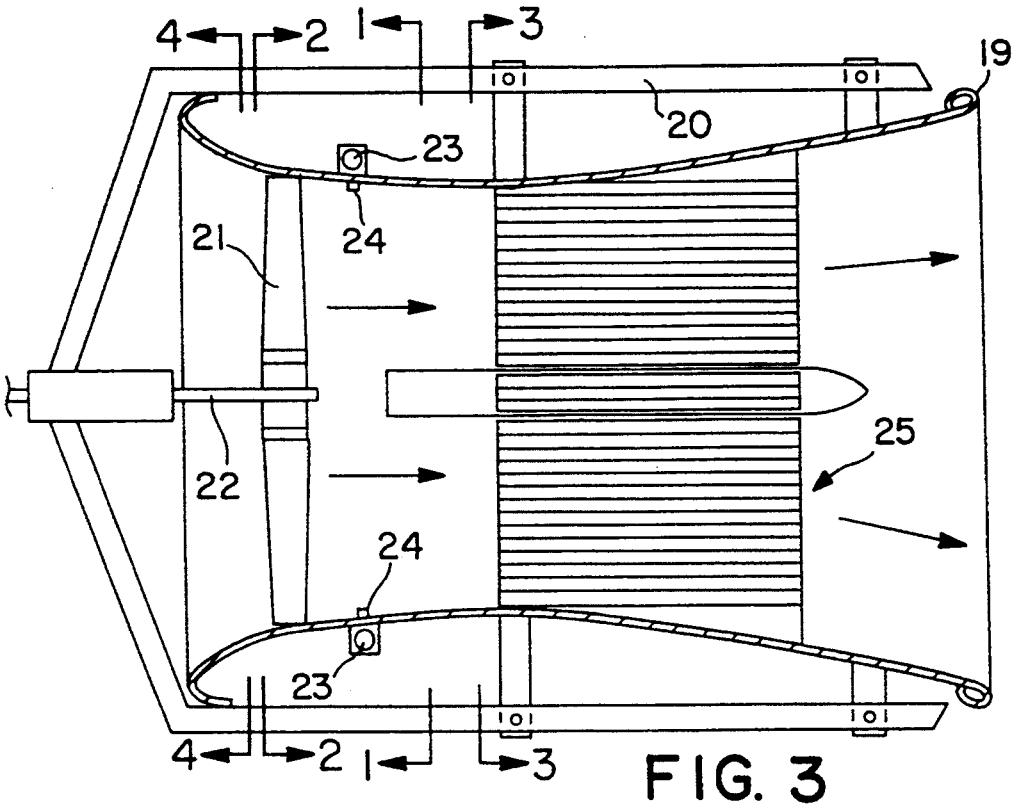
FIG. 3 is a schematic cross-sectional view from one side of a second embodiment of the invention.
Figure 4:
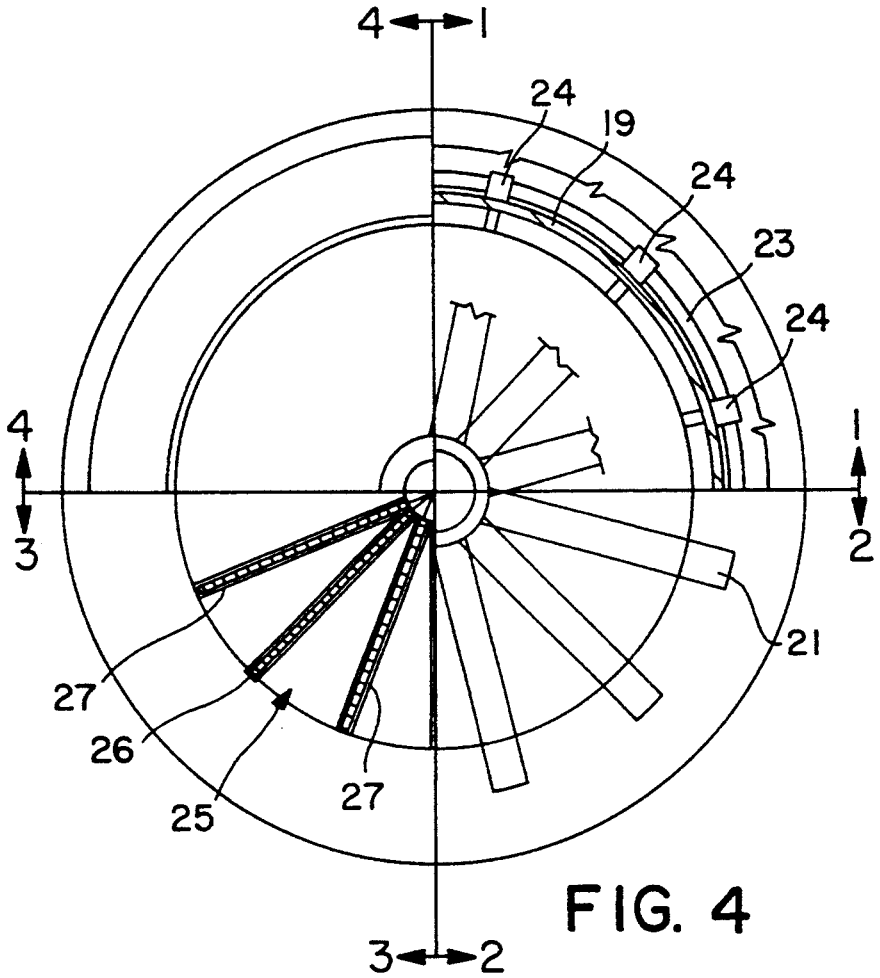
FIG. 4 is a part schematic cross-sectional end view from four different planes of the second embodiment as marked in FIG. 3.

A second embodiment of the invention is shown in FIGS. 3 and 4. This embodiment is intended for large scale generation of fire fighting foam, and is mounted on a towable trailer or fire tender.

A duct, this time in the form of a cylindrical wing 19 is mounted to a frame 20. A fan 21 is mounted on an axle 22 and driven by a motor, not shown, but in this embodiment is also mounted on the trailer.

A mixer is fed from one side by a water inlet, and by the other by an inlet for foaming chemicals, in much the same way as in the first embodiment of the invention. The mixture is pumped by a pump to conduit 23, extending around a peripheral portion of the cylindrical wing 19. Jets 24 are spaced apart and fed from the conduit 23 and so directed to spray the mixture of water and foaming chemicals in the direction that air is blown into the cylindrical wing 19 by fan 21. The pump brings the water and foaming chemical to a pressure of at least 200 p.s.i. and the jets are selected so as to atomize the fluid mixture into the duct. This gives rise to a very effective mixing of the air blown into the cylindrical wing and the mixture atomized.

A catalytic unit 25 is mounted on axle 22 and comprises a support structure of sixteen wings 26 extending radially outwards from the axle 22. Closely wound around these wings is a mesh of metal wire 27 which acts as the catalytic agent. The entire catalytic unit is stationary. The fan 21 causes a swirling of the air and this swirling action causes the foam to make effective contact with the catalytic unit.

The axle 22 is driven by an internal combustion engine also mounted on the trailer.

In an alternative form this second embodiment of the invention may be mounted to an aircraft. Axle 22 thus does not extend from an internal combustion engine but simply interconnects to fan 21 with the catalytic structure. As the aircraft travels, the relative airspeed turns fan 21, to propel the air through the cylindrical wing and at the same time rotates the catalytic unit. The water and foaming chemical mixture can then be pumped through jets 24 through the catalytic unit to generate foam which is dumped from the aircraft onto the seat of a fire or an area to be protected from fire.

Figure 5:
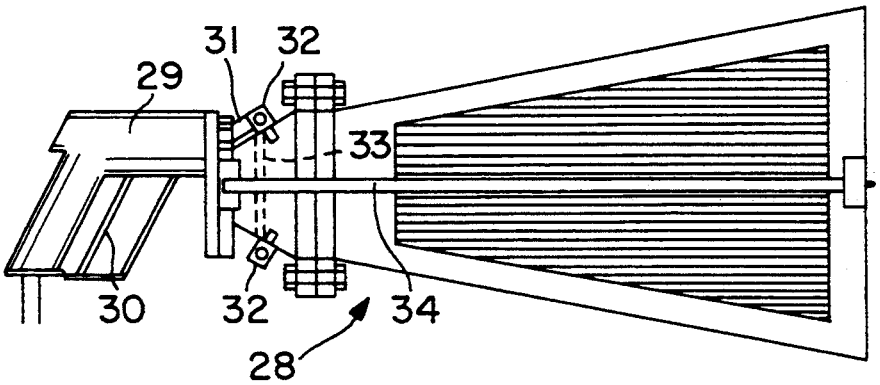
FIG. 5 is a part schematic cross-sectional view of a hand held nozzle of a third embodiment of the invention.

In a third embodiment the invention can be carried by an individual on a backpack. Thus a mixture of water and foaming chemical can be stored in a first tank under pressure. A second tank has pressurised air stored above approximately 170 p.s.i. Outlets from both tanks lead into a mixer, and an outlet from this mixer then leads into a hand held nozzle 28 as illustrated in either FIG. 5 or FIG. 6.

In an alternative form a trolley may be provided having a container of pre-mixed water and foaming chemical, a mixer, including an air inlet allowing for intake of air from the atmosphere is provided. Atmospheric air is drawn into the mixer by reason of a pump downstream of the mixer. The pump has an outlet that leads to one of the two hand held nozzles as illustrated in either FIG. 5 or FIG. 6.

The two illustrated nozzles each have a grip 29 and a trigger 30 to actuate a valve that regulates flow of the mixture of air, water and foaming chemical. On actuation the mixture then travels through conduit 31 and in the embodiment shown in FIG. 5 straight to two jets 32, which are in communication with one another through the further conduit 33, shown in broken lines.

Mounted for rotation on axle 34 within the nozzle is a catalytic unit including wings extending radially from the axle and having a helical twist with respect to the axle. The pressure of the foam issuing from jets 32 drives the catalytic unit directly in the embodiment illustrated in FIG. 5.

Figure 6:
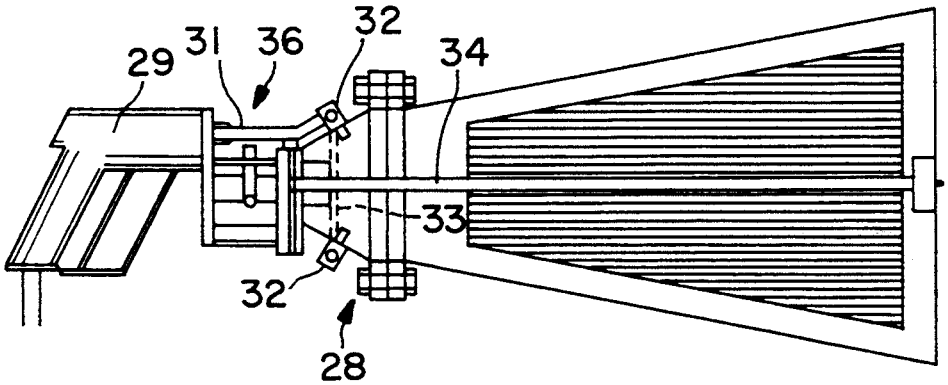
FIG. 6 is a part schematic cross-sectional view of an alternative hand held nozzle.

The embodiment shown in FIG. 6 however has a hydraulic motor 36 coupled to one end of the axle 34. The hydraulic motor is driven by the pressure of the mixture in conduit 31.

Figure 7:
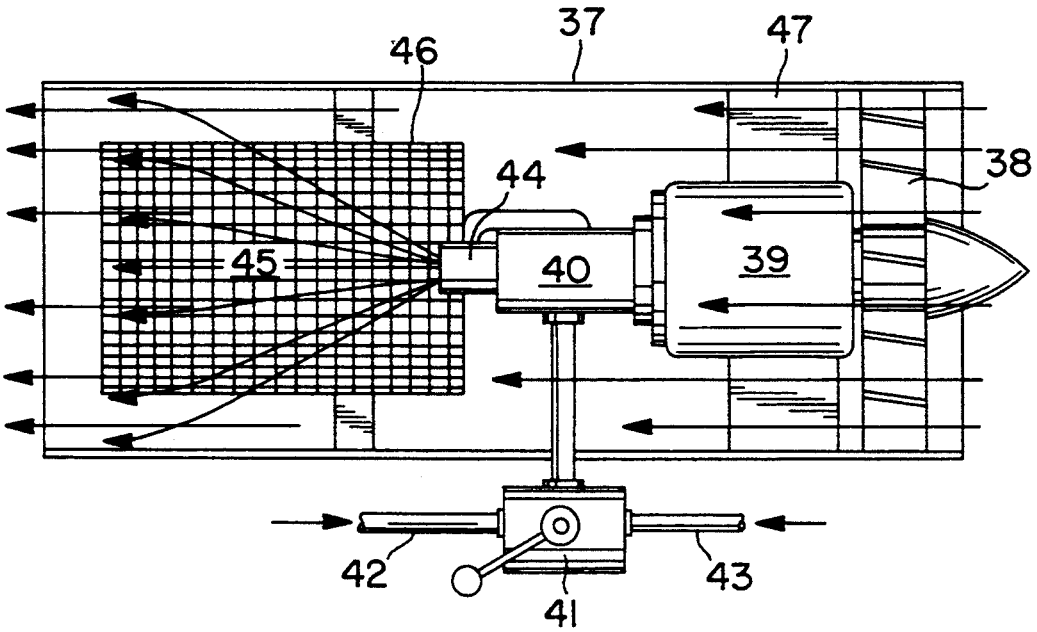
FIG. 7 is a schematic cross-sectional view of a further embodiment of the invention.

In the embodiment illustrated in FIG. 7, a duct 37, which may be formed of various sections, has in it at one end a fan 38 which is coupled to a motor 39 and is arranged to blow a volume of air into the duct.

Also driven by the motor is a liquid pump 40 which has its inlet connected to a mixer 41 to which water is fed through a line 42 while foam forming chemicals is fed through a line 43, mixer 41 being arranged as a flow control member to regulate the proportions of the water and the foam-forming chemical drawn into the pump 40.

The outlet of the pump 40 is connected to a jet 44 of any approved type which sprays the mixture of water and foam forming chemical into the area 45 to preferably fill the duct in this area. In this area is disposed the catalysing unit 46 which in this case is a mesh of bronze wire onto which and through which the liquid mixture is directed.

The mixture of water and the foam forming chemical is directed into the selected velocity airstream flowing into the duct 37 and with the aid of the catalysing unit 46 is distributed in the air in the form of foam. The moisture content of which can be controlled through the mixer 41 by appropriate regulation of the foam forming chemical and water mix, which foam can then be directed to the seat of a fire, or to an area to be protected, by simply aiming the duct to the site.

The motor 39 and fan 28 can be of any selected type, and the airstream generated can be directed by baffles 47 in the duct to maintain required flow along the duct. The pump also can be of any approved type and is as said coupled to flow control means 41 and to a jet 44 so that the fire retarding liquid can be pumped at high pressure into the airstream for foam forming purposes.

It is of course possible to use sensors in the unit to measure the consistency of the fluid and foam passing through the duct and such sensors can be coupled to computer means which can then regulate the valves in the mixer 41 to achieve and maintain the required information.

It is also possible to connect such a unit to external sensors so that the unit is switched on at appropriate times when there is a fire warning, and such sensors of course can be associated with the fire fighting foam generation unit itself by being for instance in the nature of infrared sensors directed to the areas which are being sensed. In this regard it is possible to mount the fire fighting foam generation system to allow the unit to move or orientate to direct the foam to a number of areas as selected by appropriate sensors, or stream directing vanes or the like can be associated with the duct, or at the area at the termination of the duct to allow the air-jet carrying the foam to be directed to different areas as required.

The axis of the fan 38, the motor 39, the pump 40 and the jet 44 can be coaxial with the duct 37 so that a neat assembly is provided with minimal obstruction to the airstream generated by the fan, while the catalysing unit 46 can be arranged in any convenient manner in the path of the output from the jet 44 and can be in the form of vanes as well as in the form of a mesh structure as shown which for instance can have its wall positioned so that the liquid from the jet 44 is directed outwardly through it into the airstream.

The full line arrows indicate airflow and the dotted lines the path of the foam forming liquid.

I claim:

1. A fire-fighting foam-generation system installed within an air conditioning duct, the system comprising:

a motor mounted in the duct and having drive shafts extending out of opposite ends thereof, the shafts extending longitudinally within the duct;

an axial fan mounted on one of the shafts to generate a flow of pressurized air within the duct, flowing in a direction extending from upstream to downstream, the shaft on which the axial fan is mounted being downstream of the motor;

a pump mounted on the other of the shafts, upstream of the motor;

a mixing valve to mix water from a water supply line with a foam-forming chemical from a foam-forming chemical supply line;

spray nozzles downstream of the motor;

pipes, interconnecting the pump with the mixing valve and the spray nozzles, permitting the pump to pump the mixture of water and foam-forming chemical from the mixing valve to the spray nozzles, the spray nozzles generating a foam;

a plurality of grid panels downstream of the axial fan, mounted to turn with the shaft that is downstream of the motor, the nozzles being directed onto the grid panels to spray foam onto the grid panels to enhance the generation of foam within the duct in cooperation with the flow of pressurized air.

* * * * *